US005515089A

United States Patent [19]

Herko et al.

[11] Patent Number: 5,515,089

[45] Date of Patent: May 7, 1996

[54] INK JET PRINTHEAD WITH SEALED MANIFOLD AND PRINTHEAD DIE

[75] Inventors: Lawrence H. Herko, Walworth; Peter J. Nystrom, Webster, both of N.Y.

[73] Assignee: Xerox Corporation, Stamford, Conn.

[21] Appl. No.: 987,914

[22] Filed: Dec. 8, 1992

[51] Int. Cl.[6] ..... B41J 2/05

[52] U.S. Cl. ..... 347/63

[58] Field of Search ..... 346/1.1, 140 R; 156/626, 633; 347/61, 65, 63, 20, 84

[56] References Cited

U.S. PATENT DOCUMENTS 4,612,554 9/1986 Poleshuk ..... 346/140 R
4,935,750 6/1990 Hawkins ..... 346/140 R
5,010,355 4/1991 Hawkins et al. ..... 346/140 R
5,258,781 11/1993 John ..... 346/140 R
5,333,007 7/1994 Kneezel et al. ..... 347/20

*Primary Examiner*—Benjamin R. Fuller
*Assistant Examiner*—Alrick Bobb
*Attorney, Agent, or Firm*—Oliff & Berridge

[57] ABSTRACT

The contiguous inlets of components of a thermal ink jet printhead are sealed by applying a sealant to provide a substantial but not complete seal around the edge of an inlet of the printhead die mounted on a heater plate to provide an edge free of sealant and by injecting a liquid encapsulant to seal the contiguous inlets of the die and a manifold at the edge free of sealant.

27 Claims, 7 Drawing Sheets

INK JET PRINTHEAD WITH SEALED MANIFOLD AND PRINTHEAD DIE

BACKGROUND OF THE INVENTION

1. Field of the Invention

The invention relates to an improved ink jet printhead, and more particularly to a process for sealing a manifold to a printhead die and to a thermal ink jet printhead with sealed manifold and printhead die.

2. Description of Related Art

A thermal ink jet printhead is a device which ejects fluid (ink) in a controllable fashion by means of electrical pulses passed through resistive heating elements which are in thermal contact with the ink. Ink from a reservoir travels through a manifold located above a printhead die and into the printhead die through an ink inlet. The printhead die consists of a channel plate in which fluidic pathways are formed for example by etching, bonded on top of a heater plate. The heater plate may contain heating elements, leads and preferably some addressing electrodes to reduce required interconnection density. Insofar as possible, the microelectric packaging of the printhead die follows IC and hybrid industry standard methods such as epoxy die bonding of the silicon device onto the substrate, as well as wire bonding to accomplish electrical interconnection. However, the fluid handling requirements of the printhead give rise to additional packaging requirements.

As part of the printhead, a manifold is mounted to a substrate having an interconnection board and the printhead die is mounted on a heater plate situated in the substrate. The manifold has an inlet and the manifold is positioned over the printhead die so that the inlet is contiguous with a corresponding inlet in the die to form a continuous passageway. The manifold provides an ink supply through the inlets to the printhead die. Hence, the ink inlet of the thermal ink jet die must be sealingly positioned against and coincident with the ink inlet of the manifold. A tight seal has required applying seal bead completely around the inlet orifice of the die prior to positioning of the manifold.

The printhead die is diced from a silicon wafer which has been etched with elongated slots. Hawkins, U.S. Pat. No. 4,935,750 describes a method for producing the die from a wafer and the description of this patent is incorporated herein by reference. Downsizing of the printhead die is desirable because as the area of the die is decreased, the die may be manufactured more quickly and more dies may be manufactured per wafer of stock material. A limiting factor to reducing the area of the printhead die is that a sufficient area is required around the inlet for the purpose of supporting sealant to provide an adequate seal to the orifice of the manifold inlet.

SUMMARY OF THE INVENTION

In accordance with the present invention, an ink jet printhead comprises a heat sinking substrate, a heater plate with wire bond pads mounted on the substrate, a printhead die mounted on the heater plate and comprising a channel section with an ink inlet, an interconnecting board bonded to the substrate having wire bond pads corresponding to the pads of the heater plate, a plurality of wire bonds electrically interconnecting the wire bond pads on the heater section and the interconnection board, a manifold mounted to the substrate with an inlet contiguous with the inlet of the printhead die and overlapping the die and heat plate to form a cavity between the upper surface of the heater plate and lower surface of the manifold, sealant applied to the edges of the contiguous inlets substantially but not completely around said edges with at least a portion of one side of the die inlet being free of sealant, and an encapsulant encapsulating the wire bonds, at least partially filling the cavity, and at least partially sealing the inlets to form a continuous passageway. The encapsulant may partially fill the cavity to form a wall of the inlet of the printhead die contiguous with the inlet of the manifold to form the continuous passageway. Additionally, the manifold may comprise a surface extended to commonly form a wall of the contiguous inlets and to define the cavity between the printhead die and the manifold when positioned over the substrate.

In addition, the invention relates to a method of sealing components of a thermal ink jet printhead, comprising the steps of applying a sealant to provide a substantial but not complete seal around the edge of an inlet of a printhead die mounted on a heater plate with at least one side of the inlet being substantially free of sealant; positioning a manifold having an inlet contiguous with the inlet of the printhead die over an interconnection board and the printhead die to form a cavity defined between at least a portion of the top surface of the heater plate and the bottom surface of the manifold, and to form a continuous passageway between the inlets; and injecting a liquid encapsulant to encapsulate wire bonds between the printhead die and the interconnection board to at least partially fill the cavity between the heater plate and the manifold and at least partially seal the contiguous inlet of the printhead die and manifold at the edge free of sealant.

The liquid encapsulant can be partially injected into the cavity between the printhead die and the manifold to form a wall of the inlet of the printhead die contiguous with the inlet of the manifold. The manifold may comprise a surface extended to commonly form one wall of the inlet of the printhead die and to define a wall of the cavity between the heater plate and the manifold when positioned over the mounted printhead die.

BRIEF DESCRIPTION OF THE DRAWINGS

The invention will be described in detail with reference to the following drawings wherein.

DETAILED DESCRIPTION OF PREFERRED EMBODIMENTS

Figure 1:
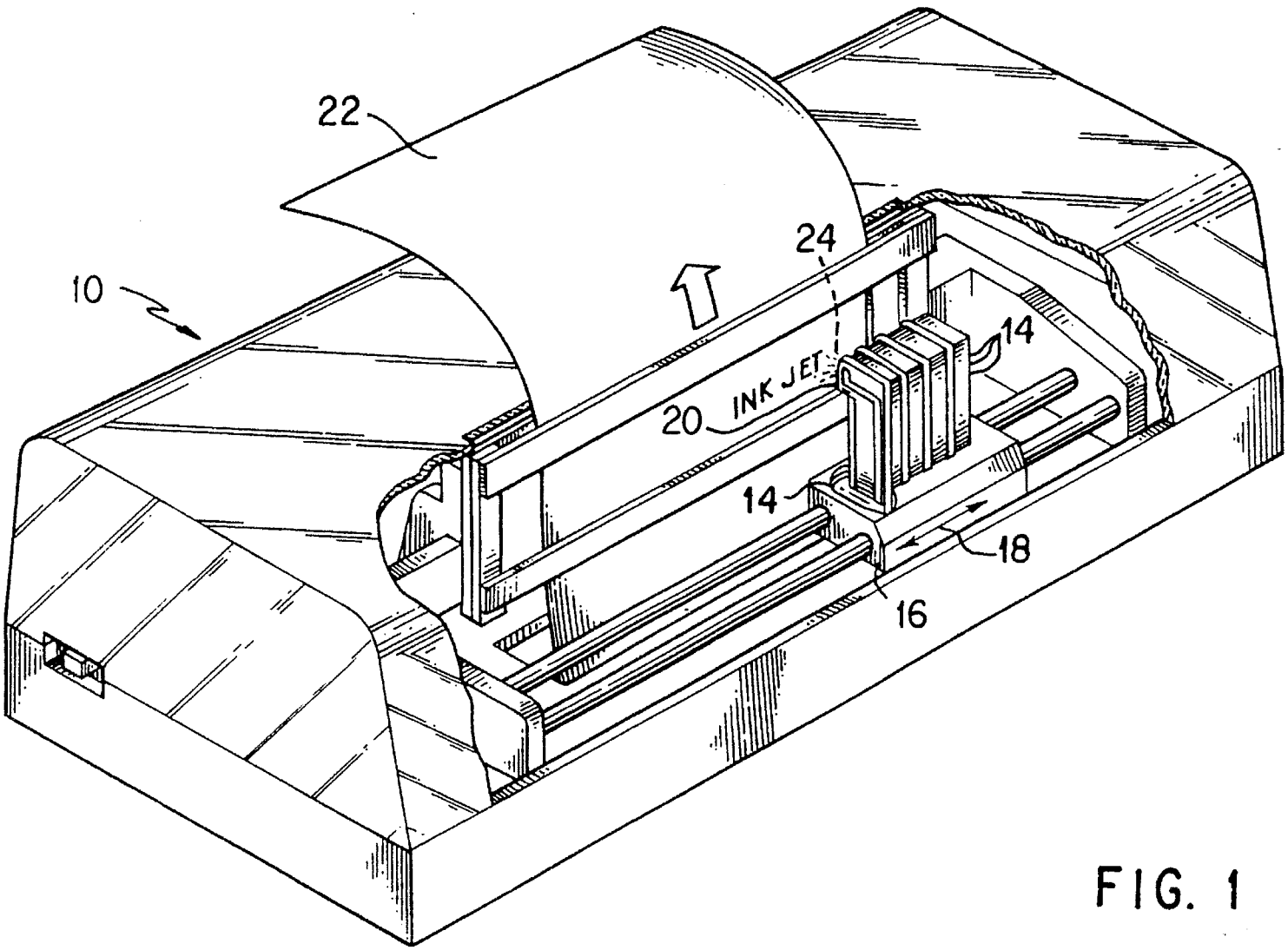
FIG. 1 is a perspective view of a thermal ink jet printer to which the present invention is directed.

A typical carriage-type, multicolor, thermal ink jet printer 12 is shown in FIG. 1. A linear array of ink droplet producing channels (not shown) is housed in each printhead 14. One or more printheads 14 are replaceably mounted on a reciprocating carriage assembly 16, which reciprocates back and forth in the direction of the arrows 18 as shown. The ink channels terminate with orifices or nozzles 20 which are aligned perpendicular to the surface of a recording medium 22, such as paper. Droplets 24 are expelled and propelled to the recording medium 22 from the nozzles 20 in response to digital data signals received by a printer controller, which in turn selectively addresses individual heating elements with a current pulse, the heating elements being located in the printhead channels a predetermined distance from the nozzles 20. The current pulses passing through the printhead heating elements vaporize the ink contacting the heating elements and produce temporary vapor bubbles to expel the droplets of ink 24 from the nozzles 20. A single printhead array may be used, or multiple arrays may be butted together to form a large array or a pagewidth printhead. Additionally, one or more of these arrays may be stacked such that each array expels a different color of ink for multicolor printing.

Figure 2:
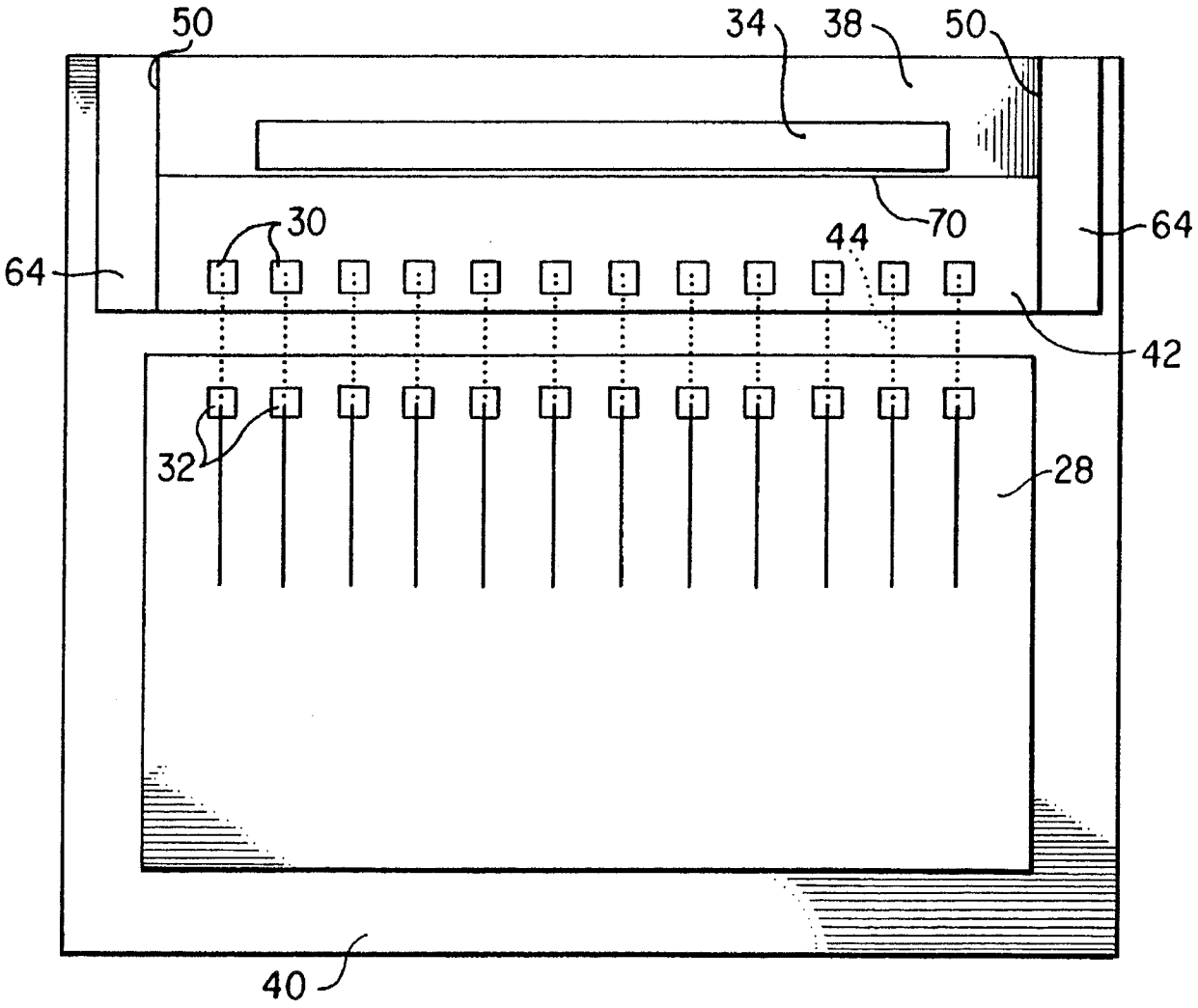
FIG. 2 is a top view of a thermal ink jet die and an interconnection board which have been bonded to a heat sinking substrate.
Figure 3A:
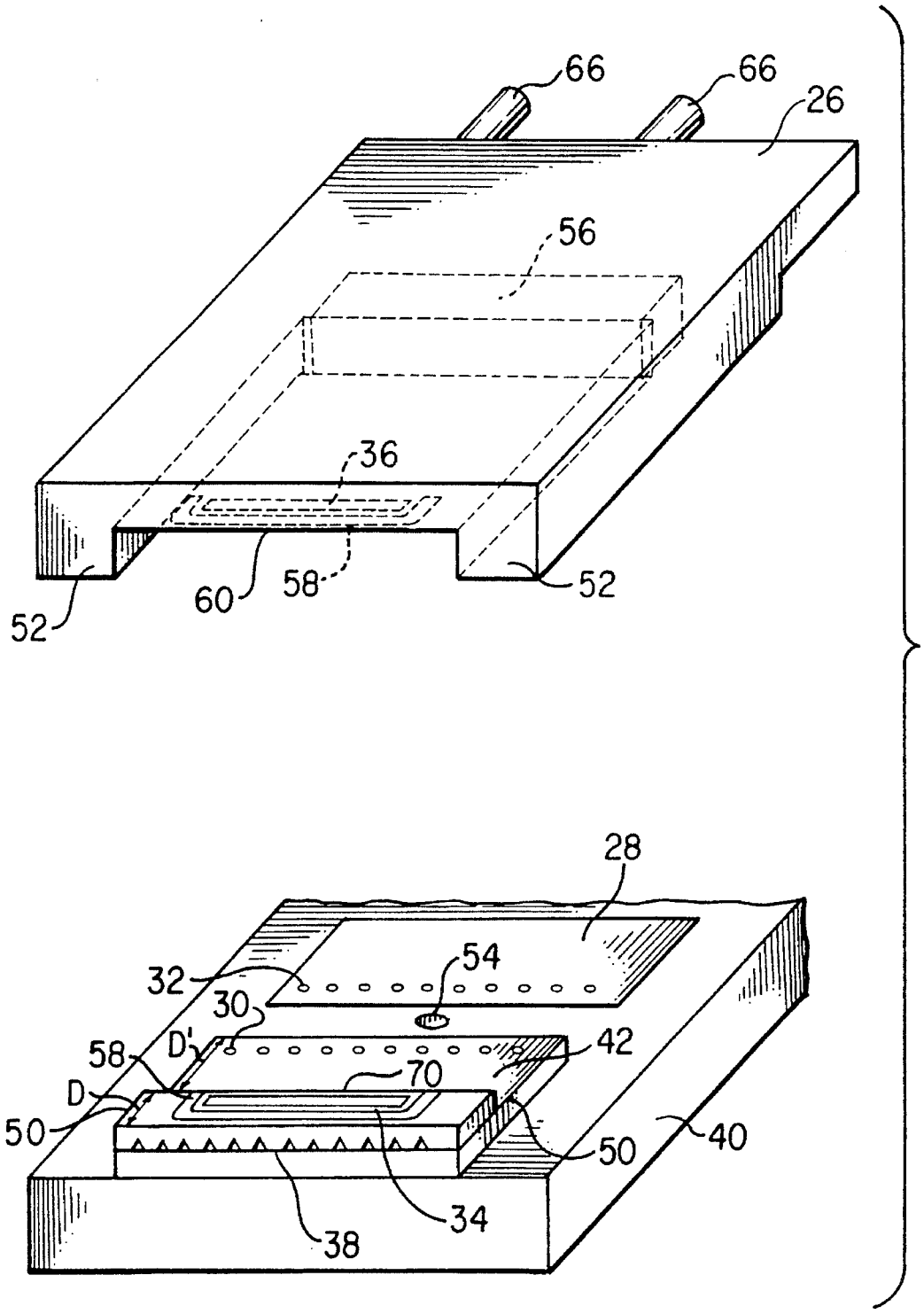
FIGS. 3*a*, 3*b* and 3*c* are perspective views of a printhead die and a manifold which is positioned over an ink inlet of the die prior to bonding. Each of FIGS. 3*a*, 3*b* and 3*c* illustrates a different embodiment of the present invention.
Figure 3B:
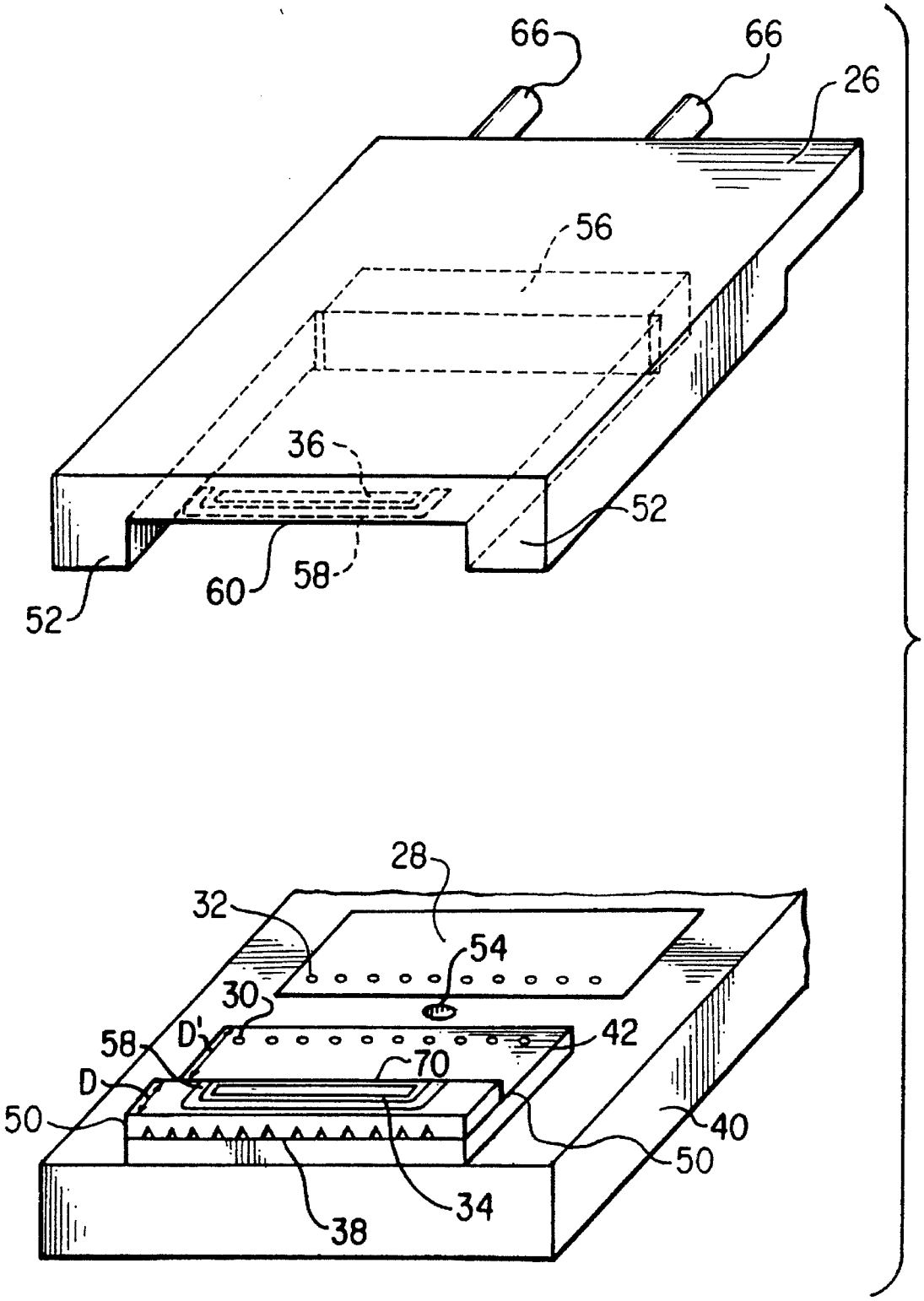
Figure 3C:
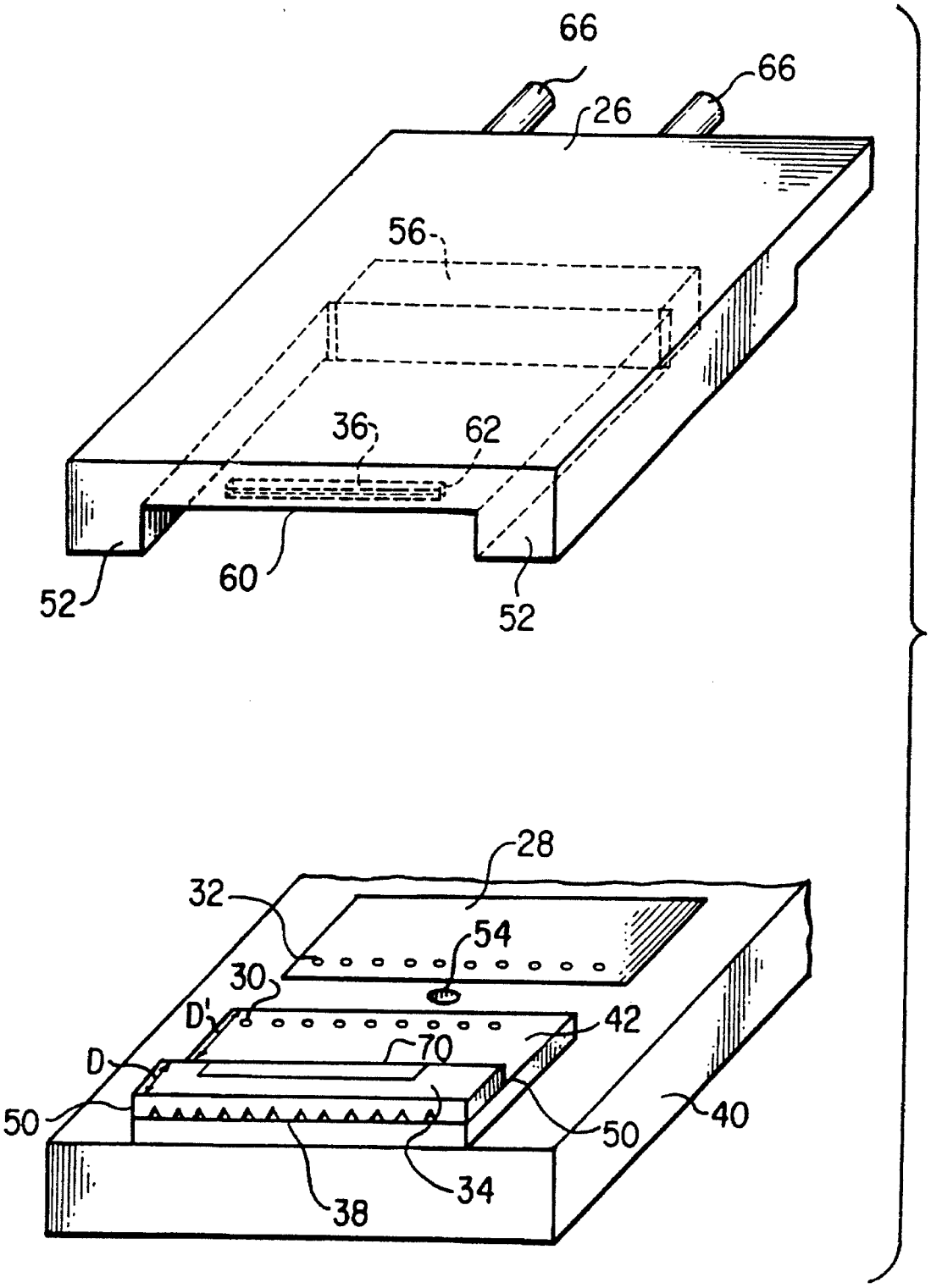
Figure 4A:
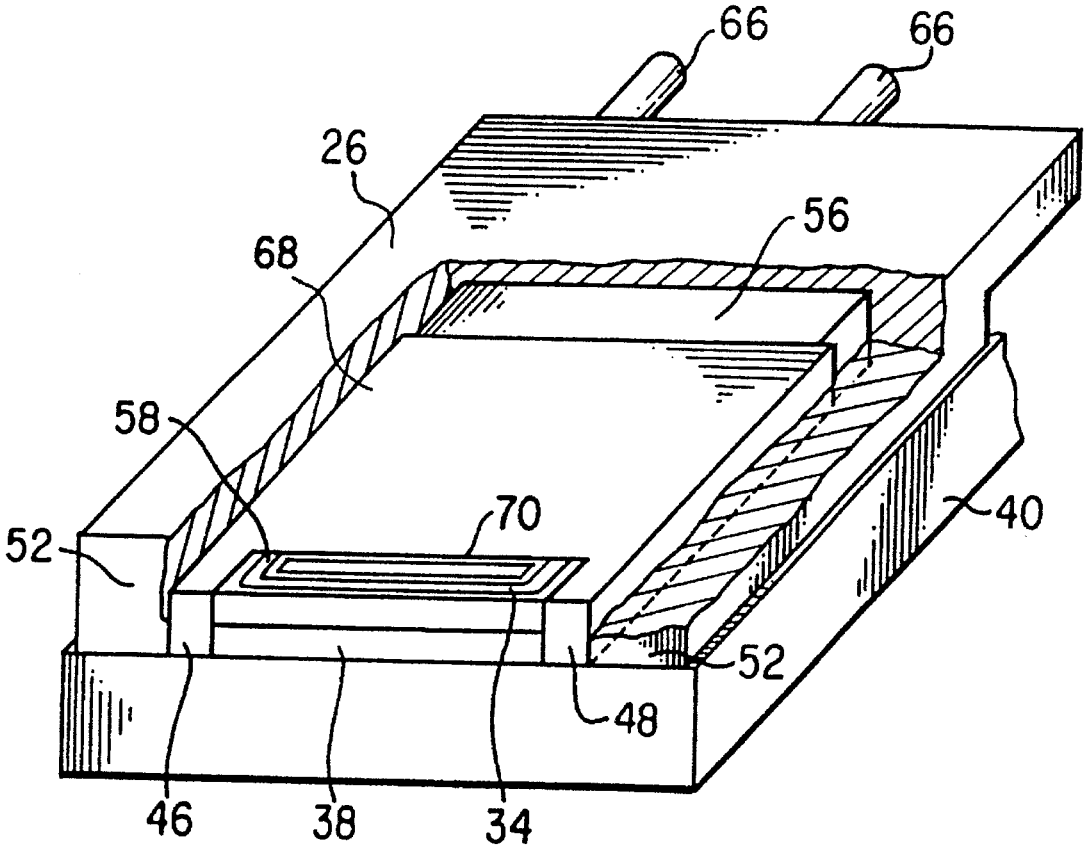
FIGS. 4*a*, 4*b* and 4*c* are perspective views of the printhead die and manifold of FIGS. 3*a*, 3*b* and 3*c* after encapsulant has been injected. In each Figure, the manifold is shown in outline form to better show the internal components.
Figure 4B:
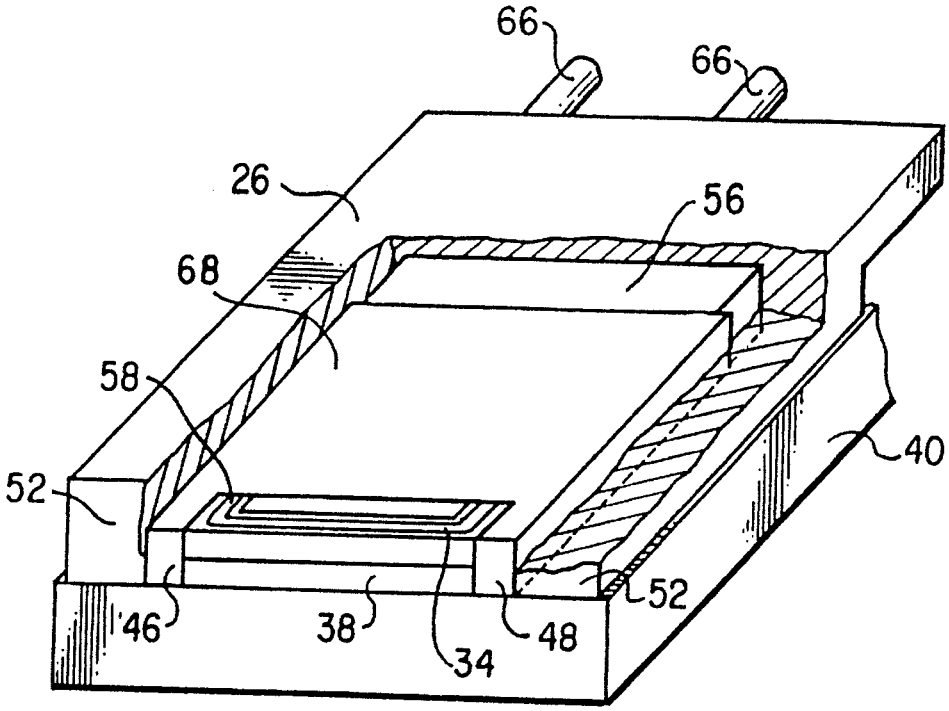
Figure 4C:
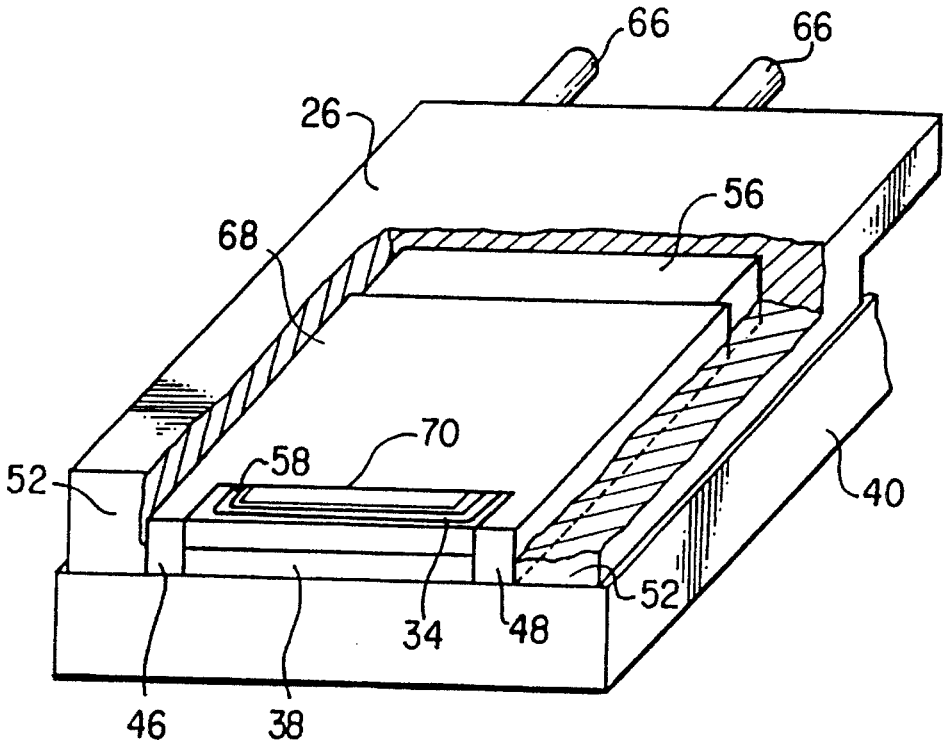

Referring to the figures, a printhead 14 includes an ink supply manifold 26 fixedly mounted on an interconnection board or daughter-board 28 having electrodes 32. The interconnection board may be wire bondable PC board, thick film on ceramic or thin film on ceramic for example. Beneath the manifold 26 and as shown in FIGS. 3–4 are a heater plate 42 having electrodes 30 and a thermal ink jet die 38 having an ink inlet 34. The interconnection board 28, the heater plate 42 and thermal ink jet die 38 are mounted on a heat sinking substrate 40, with the manifold 26 attached to the substrate 40 and overlying the heater plate 42, thermal die 38 and a portion of the interconnection board 28. The electrodes 32 of the interconnection board are bonded by bonds 44 to the electrode 30 of the heater 42 as shown in FIG. 2. FIGS. 3*a*, 3*b* and 3*c* do not show the bonds 44 for clarity. However, FIGS. 4*a*, 4*b* and 4*c* illustrate that the ink inlet 34 of the thermal ink jet die 38 is sealingly positioned against and coincident with an ink inlet 36 in the manifold 26. The manifold 26 also includes vent tubes 66 which connect the manifold with an ink supply 68.

A plan view of the L-shaped interconnection board 28 is shown in FIG. 2. This view is of the side containing the printhead 14. Interconnection board electrodes 32 are on a one-to-one ratio with the electrodes 30 of the printhead 14 as shown in FIGS. 3*a*–3*c*. The printhead 14 is sealingly and fixedly attached to the interconnection board 28 and its electrodes 30 are wire bonded by bonds 44 to the interconnection board electrodes 32. All of the electrodes 30, 32 are passivated and the wire bonds 44 are encased in an electrical insulative material such as epoxy. Opposite ends of electrodes 32 are connectably attached to appropriate controls in the printer 12.

The thermal ink jet die 38 is adjacent to electrical interconnection board 28, both of which are bonded onto the heat sinking substrate 40. Prior to bonding of die 38 onto heater plate 42, a screen printed silver filled die bonding epoxy 64 is patterned over an area where the die is to be bonded. It is to be understood that in FIGS. 4*a*–4*c*, the epoxy 64 is located under the die 38 and optionally extends beyond ends 50 of the die 38 as shown. On the die 38, the ink inlet 34 is shown as a rectangle. Wire bond pads or electrodes 30 from a heater plate portion 42 of the printhead 14 are shown as rectangles. Wire bonds 44 to the corresponding pads or electrodes 32 on the electrical interconnection board 28 are shown in dotted lines. Electrical connection from the board 28 to printer 10 are shown in FIG. 2, and do not form part of the present invention.

FIGS. 3*a*, 3*b* and 3*c* and 4*a*, 4*b* and 4*c* show three embodiments of the present invention. Each view of FIGS. 3*a*–3*c* is a perspective view of the components including ink manifold prior to assembly. FIGS. 4*a*–4*c* are perspective views of the components of FIGS. 3*a*–3*c* in an assembled state. The manifold 26 includes legs 52 which rest on the substrate 40 and straddle ends 50 of the thermal ink jet die 38. Gaps 46 and 48 can exist between the legs 52 and ends 50 of the die 38 when the structure is assembled as in FIGS. 4*a*–4*c*. A wire bond encapsulant is applied in a manner so as to provide structural bonding of the manifold 26 to the other printhead components, and also to fill any air gaps 46, 48 between ends 50 of the die 38 and legs or sides of the manifold 26.

The substrate 40 has a through hole 54 preferably formed by orientation dependent etching located near the center of the row of wire bonds 44 between the die 38 and the interconnection board 28. In addition, the underside 60 of the manifold 26 includes an encapsulation dam bar 56 which, when the manifold 26 is assembled onto the printhead 14, is located over the interconnection board 28 just behind the row of wire bonds 44. Alternatively instead of locating the throughhole 54 in the substrate 40, it may be provided in the manifold 26. This may be advantageous in that it allows encapsulation injection from the top rather than the bottom. The manifold 26 may be molded with the hole and the bar.

In order to assemble the manifold 26, a sealant 58 is applied around ink inlet 36 so as to seal its connection to the ink inlet 38 of the ink inlet die 38 (FIGS. 3*a*–3*c* and 4*a*–4*c*). The water tight seal 58 may be made by screen printing or syringe deposition. Alternatively, the water tight seal 58 may be applied onto the die 38 or and manifold 26 by syringe deposition. The manifold 26 is then positioned in place, for example, by using registration pins.

FIGS. 3*a*, 3*b* and 3*c* and 4*a*, 4*b* and 4*c* illustrate different embodiments of the present invention. Sealant 58 is applied substantially around the edge of manifold inlet 36 (not shown for clarity in FIG. 3*c*) prior to the positioning of the manifold 26 to the heat sinking substrate 40. As shown, the sealant 58 is applied to provide a die inlet side 70 substantially free of sealant. The sealant 58 may be applied solely to the manifold 26 in a pattern around inlet 36 so that upon positioning of the manifold 26 to die 38 the sealant 58 substantially but not completely forms around the edges of inlet 34 with at least a portion of one side 70 of inlet 34 being free or substantially free of sealant. While preferably the sealant 58 is applied to manifold 26, the sealant may be applied to both manifold 26 and die 38 or to die 38 solely, so long as a side 70 of inlet 34 is free of sealant upon positioning of the manifold 26 to the die 38. Since inlet side 70 is not required to support sealant, it may be substantially foreshortened (shown as distance D). Foreshortening of distance D is advantageous because it facilitates manufacture of the die in that an increased number of dies may be made in the same length of time and further an increased number of dies may be made from the same wafer blank.

Further by foreshortening of the distance D, the distance D' between the die 38 and the edge of the heater plate 42 is increased. This permits the injection of a liquid encapsulant as hereinafter described up to the edge of the ink inlet 34. The proximity of the encapsulant to the edge of the inlet 34 allows for the encapsulant to form the required seal along edge 70 thereby completing the formation of the contiguous and sealed passageway between inlets 34 and 36.

Further as shown in FIGS. 3*b* and 4*b* in another embodiment of the present invention, the edge 70 is eliminated completely. In this embodiment, the liquid encapsulant may be injected into the cavity between the printhead die and the manifold to a position such that upon curing, the encapsulant itself forms the wall of the inlet of the printhead die contiguous with the inlet of the manifold.

In this embodiment, a thixotropic encapsulant material may be used to form the wall or a material may be immobilized by irradiation when positioned to form the wall. Additionally, the inlet of the printhead die may be provided with a removable barrier to limit the flow of encapsulant. The injected encapsulant will flow to the limitation of the barrier and upon curing will form the inlet wall. The barrier may be removed after curing of the encapsulant.

Further as shown in 3*c* and 4*c* in another embodiment of the present invention, the ink supply manifold 26 is provided with a lip 62 extending the wall of inlet 36 in a direction toward the mating of the manifold 26 with the heater plate 42. Upon positioning of the manifold 26 to the heater plate 42, the wall 62 forms the required wall of inlet 34 thereby forming the continuous passageway between inlets 36 and 34. In this embodiment, the liquid encapsulant seals the wall 62 of the manifold directly to the surface of the heater plate 42.

After positioning of manifold 26 over printhead die 38, a liquid encapsulant such as Hysol 4323 is injected from the underside of the substrate 40 through the through hole 54 between the thermal ink jet die 38 and the interconnection board 28. The encapsulant flows laterally along the path of least resistance along the rows of wire bonds 44, being constrained by the underside 60 of the manifold (on the top), the substrate 40 (on the bottom), the die 38 (in front), and the dam encapsulation bar 56 (in the rear). This encapsulates the wire bonds 44. Preferably, the dam bar 56 is the same thickness (vertical dimension) as the die, i.e., a 1:1 ratio. However, it may be desirable that dam bar 56 does not extend all the way down to contact the interconnection board 28 (i.e., a vertical space (not shown) exists between the dam bar 56 and the substrate 40), allowing some encapsulant to spill past the bar 56 and allowing for tolerances between components. The dam bar 56 also may be of a length less than the distance between the legs 52 such that a lateral spacing exists between ends of the dam bar 56 and the legs 52 to also allow limited encapsulant flow therearound. The vertical and lateral spacings may be advantageous in that they give greater area for structural bonding of the manifold 26 to the other printhead components and also compensate for tolerances between elements.

Because the through hole 54 is located near the center of the die 38, the encapsulant reaches both ends of the die 50 at approximately the same time. It then begins to flow toward the front of the printhead to fill the air gaps 46, 48 between the ends of the die 50 and the manifold legs 52 at the side. As the encapsulant flows around the printhead die, it flows within the cavity between the heater plate and the manifold completely filling this cavity and encapsulating electrodes 34. The encapsulant fills the cavity including to a position adjacent edge 70 of the ink inlet 34 of the thermal ink jet die 38. The encapsulant at this position tightly fills the cavity to form a seal of the edge 70 of inlet 34 to inlet 36. The encapsulant participates with the sealant to form a continuous seal around the inlet 34 to inlet 36 to form a continuous passageway.

While the embodiment described in the figures shows injection of encapsulant at 54, the encapsulant may be injected through a gap between the manifold 26 and the substrate 40, through a hole in the manifold 26 itself (not shown) or through any suitable opening.

Flow of encapsulant may be controlled by time fixing the period of injection (Time-Pressure method). In another method, the encapsulant may be observed by an operator as it flows and injection can be stopped when the encapsulant is nearly to the front of the printhead 14. Preferably, this is done using an optical sensor to detect the extent of encapsulant flow. Additionally, in the case where the substrate is the same color as the encapsulant (typically black), it is preferred to provide a white background for viewing the flow of the encapsulant. This may be accomplished by extending the screen printed silver filled die bonding epoxy 64. The silver epoxy is easy to see when the encapsulant covers a dark substrate. The encapsulant is then cured to finish the assembly process. The finished printhead and interconnection board can now be assembled onto various printer components to complete the printer.

The encapsulant may be a different material than the sealant. For example, the seal may be a chemically resistant material such as a silicon rubber and the encapsulant may be an expoxy material such as Hysol 4323. However, the same material may be used as both sealant and encapsulant, for example a silicone may be used as both sealant and encapsulant.

Utilizing encapsulant 68 to provide one edge of seal between inlets 34 and 36 shown in FIGS. 3*a*–3*c* and 4*a*–4*c* permits foreshortening of distance D. Foreshortening of distance D is particularly advantageous because it permits use of a printhead die of reduced dimensions. Reducing the size of the printhead die permits faster manufacture of the die structure and allows an increased number of dies to be produced per unit wafer of stock material.

The invention has been described with reference to the preferred embodiments thereof, which are intended to be illustrative and not limiting. Various changes may be made without departing from the spirit and scope of the invention as defined in the appended claims.

What is claimed is:

1. A thermal ink jet printhead comprising:

a heat sinking substrate;

a heater plate with wire bond pads and mounted on the substrate;

a printhead die mounted on the heater plate and comprising a channel section with an ink inlet, wherein, at least a portion of an edge around the ink inlet, a width of the edge has insufficient surface area to support sealant;

an interconnection board bonded to the substrate and having wire bond pads corresponding to the pads of said heater plate;

a plurality of wire bonds electrically interconnecting the wire bond pads on the heater plate and the interconnection board;

a manifold mounted to the substrate with an inlet contiguous with the inlet of said printhead die and overlapping said die and heater plate to form a cavity between said heater plate and said manifold;

a sealant applied to edges of the contiguous inlets between said manifold and said die, substantially but not completely around said edges with at least a portion of the edges being free of said sealant; and an encapsulant encapsulating said wire bonds, at least partially filling said cavity, and at least partially sealing said contiguous inlets at said portion of the edges free of said sealant to form a continuous passageway between said inlets.

2. The thermal ink jet printhead of claim 1, wherein said encapsulant partially fills said cavity to form a wall of the inlet of the printhead die contiguous with the inlet of said manifold to form a continuous passageway.

3. The printhead of claim 1, wherein said manifold comprises a surface extended to commonly form a wall of the contiguous inlets and to define the cavity between said printhead and said manifold when positioned over said substrate.

4. The thermal ink jet printhead of claim 1, wherein said heat sinking substrate has a through hole formed therein communicating with the cavity.

5. The printhead of claim 4, wherein the channel section, heater plate, through hole and interconnection board define a longitudinal direction of the substrate, a side of the through hole extending toward the channel section defining a forward direction and a side of the through hole extending toward the interconnection plate defining a rearward direction, the cavity having a width in a transverse direction perpendicular to the longitudinal direction.

6. The printhead of claim 5, further comprising constraining means adjacent the interconnection board for constraining the flow of encapsulant in the rearward direction.

7. The printhead of claim 6, wherein the constraining means is a dam bar mounted on an undersurface of the manifold and extending substantially across the cavity in the transverse direction.

8. The printhead of claim 5, wherein the manifold has legs extending in the longitudinal direction and straddling the printhead die and interconnection board, the legs defining the width of the cavity and having a height defining a depth of the cavity.

9. The printhead of claim 8, further comprising constraining means adjacent the interconnection board for constraining the flow of encapsulant in the rearward direction.

10. The printhead of claim 9, wherein the constraining means is a dam bar mounted on an undersurface of the manifold and extending substantially across the cavity in the transverse direction.

11. A method of sealing components of a thermal ink jet printhead having a heater plate and an interconnection board mounted on a substrate, the method comprising the steps of:

applying a sealant to provide a substantial but not complete seal around an edge of an inlet of a printhead die mounted on the heater plate, wherein at at least one portion of said edge, a width of said edge is substantially free of said sealant;

positioning a manifold having an inlet contiguous with the inlet of said printhead die on the substrate over the interconnection board and the printhead die to form a cavity defined between at least a portion of said heater plate and said manifold; and injecting a liquid encapsulant into said cavity to encapsulate wire bonds between said heater plate and said interconnection board and simultaneously to at least partially fill said cavity and to at least partially seal the contiguous inlets of said die and said manifold at said portion of the edge free of said sealant to form a continuous passageway between said inlets.

12. The method of claim 11, wherein said liquid encapsulant is partially injected into said cavity between said printhead die and said manifold to form a wall of said inlet of said printhead die contiguous with the inlet of said manifold.

13. The method of claim 11, wherein said manifold comprises a surface extended to commonly form one wall of the inlet of said manifold and one wall of the inlet of said printhead die and to define a wall of the cavity between said heater plate and said manifold when positioned over said mounted printhead die.

14. The method of claim 11, further comprising the step of stopping flow of encapsulant in a forward direction toward the printhead die when said encapsulant flows substantially in the forward direction.

15. The method of claim 11, further comprising the step of constraining said encapsulant in a rearward direction toward the interconnection board by a dam bar located on a bottom surface of said manifold and transverse to said rearward direction.

16. The method of claim 15, wherein said constraining step allows limited flow of encapsulant past said dam bar to enhance structural bonding.

17. The method of claim 11 comprising providing a removable barrier to define a wall of said inlet of the printhead die and injecting said liquid encapsulant to at least partially fill said cavity up to said removable barrier, curing said encapsulant and removing said barrier to form a wall of said inlet of the printhead die.

18. The method of claim 11, wherein said sealant is applied to an edge of the inlet of the manifold to provide said substantial but not complete seal upon positioning of the manifold over said interconnection board and said printhead die.

19. The method of claim 11, wherein said sealant is applied directly to the edge of the inlet of the printhead die to provide said substantial but not complete seal upon positioning of the manifold over said interconnecting board and said printhead die.

20. The method of claim 11, wherein said sealant is applied to both the edges of the inlets of the manifold and the printhead die to provide said substantial but not complete seal upon positioning of the manifold over said interconnecting board and said printhead die.

21. A method of sealing components of a thermal ink jet printhead having a heater plate and an interconnection board mounted on a substrate, the method comprising the steps of:

applying a sealant to provide a substantial but not complete seal around an edge of an inlet of a manifold, wherein at at least one portion of said edge, a width of said edge is substantially free of said sealant;

positioning said manifold on the substrate over the interconnection board and a printhead die mounted on the heater plate, said printhead die having an inlet, to form a cavity defined between at least a portion of said heater plate and said manifold, and said inlet of said manifold contiguous with said inlet of said printhead die; and injecting a liquid encapsulant into said cavity to encapsulate wire bonds between said heater plate and said interconnection board and simultaneously to at least partially fill said cavity and to at least partially seal the contiguous inlets of said die and said manifold at said portion of the edge free of said sealant to form a continuous passageway between said inlets.

22. The method of claim 21, wherein said liquid encapsulant is partially injected into said cavity between said printhead die and said manifold to form a wall of said inlet of said printhead die contiguous with the inlet of said manifold.

23. The method of claim 21, wherein said manifold comprises a surface extended to commonly form one wall of the inlet of said manifold and one wall of the inlet of said printhead die and to define a wall of the cavity between said heater plate and said manifold when positioned over said mounted printhead die.

24. The method of claim 21, further comprising the step of stopping flow of encapsulant in a forward direction toward the printhead die of the printhead when said encapsulant flows substantially in a forward direction.

25. The method of claim 21, further comprising the step of constraining said encapsulant in a rearward direction toward the interconnection board by a dam bar located on an undersurface of said manifold and transverse to said rearward direction.

26. The method of claim 25, wherein said constraining step allows limited flow of encapsulant past said dam bar to enhance structural bonding.

27. The method of claim 21, comprising providing a removable barrier to define a wall of said inlet of the printhead die and injecting said liquid encapsulant to at least partially fill said cavity up to said removable barrier, curing said encapsulant and removing said barrier to form a wall of said inlet of the printhead die.

* * * * *